US006047868A

United States Patent [19]

Petrou et al.

[11] Patent Number: 6,047,868

[45] Date of Patent: Apr. 11, 2000

[54] EXCLUSIVELY PLASTIC PINCH-GRIP HANGER

[76] Inventors: Nicoleon Petrou, 2498 Roll Dr. #407, San Isidro, Calif. 92173; David Petrou, 2010 Wendower St. (Apt. 1), Pittsburgh, Pa. 15217

[21] Appl. No.: 09/182,368

[22] Filed: Oct. 29, 1998

[51] Int. Cl.[7] ..... A47G 25/48

[52] U.S. Cl. ..... 223/96; 223/91

[58] Field of Search ..... 223/85, 96, 95, 223/93, 91

[56] References Cited

U.S. PATENT DOCUMENTS

| | | | |
|---|---|---|---|
| Re. 32,269 | 10/1986 | Bisk et al. | 223/91 |
| 3,950,829 | 4/1976 | Cohen | 223/91 |
| 4,716,634 | 1/1988 | Fan | 24/545 |
| 4,718,581 | 1/1988 | Chiaramonte | 223/96 |
| 4,884,726 | 12/1989 | Kolton et al. | 223/91 |
| 5,516,014 | 5/1996 | Garrison | 223/96 |
| 5,890,634 | 4/1999 | Zuckerman et al. | 223/96 |

*Primary Examiner*—Bibhu Mohanty
*Attorney, Agent, or Firm*—Amster, Rothstein & Ebenstein

[57] ABSTRACT

A pinch-grip hanger formed exclusively of plastic includes a hanger body formed exclusively of plastic, an attachment portion formed exclusively of plastic for securing the hanger body to a support, and at least one pinch-grip formed exclusively of plastic depending from the hanger body for receiving an article there between. The pinch-grip includes a pair of components formed exclusively of plastic (each component including a bottom end for receiving the article there between and a top end), a spring formed exclusively of plastic for biasing the bottom ends together into an abutting, closed orientation while permitting separation of the bottom ends to a separated, open orientation, and a spine formed exclusively of plastic, separate from the spring, for pivotally securing together the components.

11 Claims, 5 Drawing Sheets

EXCLUSIVELY PLASTIC PINCH-GRIP HANGER

BACKGROUND OF THE INVENTION

The present invention relates to a pinch-grip hanger, and more particularly to such a hanger formed exclusively of plastic.

Pinch-grip hangers are well known in the hanger art. Such a hanger has a hanger body, an attachment portion for securing the hanger body to a support (such as a rod), and at least one pinch-grip depending from the hanger body for receiving an article for hanging. Where the hanger body suspended from the attachment portion has a pinch-grip at each end thereof, such a hanger is often referred to as an "end-clip hanger body." The pinch-grip typically includes a pair of components, each of the components including a bottom end and a top end. The article is received between the bottom ends of the two components for suspension thereby. The typical pinch-grip additionally includes means for biasing the component bottom ends together into an abutting, closed orientation while permitting separation of the bottom ends to a separated, open orientation.

There are two basic types of pinch-grip hangers. In the first type, the biasing means is always operative to bias the bottom ends of the components together into an abutting closed orientation, the force exerted by the user in opening the pinch-grip necessarily being sufficient to overcome the force exerted by the biasing means. The second type—and this is the type to which the present invention is directed—has a biasing means which is moveable between an inoperative, raised position and an operative, lowered position relative to the components. In the lowered operative position, the biasing means biases the component bottom ends together into an abutting, closed orientation. However, when the user raises or elevates the biasing means to an elevated, inoperative position, the biasing means does not bias the component bottom ends together into the abutting, closed orientation. Thus the user is then able to separate the component bottom ends with minimal force to insert therebetween an article to be suspended.

For economic reasons and ease of manufacture, the hanger is typically formed primarily of plastic with the hanger body, the attachment portion and the component pair of the pinch-grip being formed exclusively of plastic. For practical reasons, however, the hanger is not formed exclusively of plastic. The biasing means (which biases the bottom ends of the components together into an abutting, closed orientation while permitting separation of the bottom ends to a separated, open orientation) have been formed of metal or other non-plastic materials in order to provide the high degree of biasing ideally required for the biasing means. Clearly the biasing means must be strong enough to maintain the bottom ends in the abutting, closed orientation (or a non-abutting, semi-closed orientation when the article being suspended is disposed between the bottom ends), or the article may accidentally drop off the hanger. Another stumbling block in the path of an all-plastic pinch-grip is the need to maintain the two bottom ends of the components juxtaposed so that they exert an appropriate clamping action on the article there between when they are in the semi-closed orientation. Where the components are separate from each other, and connected only by a single hinge they can, under the influence of the biasing means, become mis-aligned and thus incapable of successfully maintaining an article between the bottom ends thereof.

In the typical pinch-grip hanger, the biasing means is movable between a downward or operative position wherein it biases the bottom ends together into an abutting, closed orientation and an upward or inoperative position permitting separation of the bottom ends to a separated, open orientation. However, while the upward position of the biasing means permits manual separation of the bottom ends, it frequently does not cause the bottom ends to separate automatically into the separated, open orientation. Thus the user of the hanger must manually separate the bottom ends to enable articles to be placed there between. Thus the need remains for a pinch-grip hanger which automatically moves the bottom ends into a separated open orientation when the biasing means is moved to the upward position.

Accordingly, it is an object of the present invention to provide a pinch-grip hanger formed exclusively of plastic.

Another object is to provide such a hanger wherein each pinch-grip includes spine means, separate from the biasing means, for pivotally securing together the components and ensuring appropriate alignment of the bottom ends thereof.

It is also an object of the present invention to provide such a hanger wherein the bottom ends of the components are biased towards a separated, open orientation.

A further object is to provide such a hanger which is inexpensively and easily manufactured, used and maintained.

SUMMARY OF THE INVENTION

It has now been found that the above and related objects of the present invention are obtained a pinch-grip hanger formed exclusively of plastic and comprising a hanger body, an attachment portion and at least one pinch-grip. The hanger body is formed exclusively of plastic. The attachment portion is formed exclusively of plastic for securing the hanger body to a support. The at least one pinch-grip is formed exclusively of plastic for receiving an article for hanging and depends from the hanger body. The pinch-grip includes a pair of components formed exclusively of plastic (each of the components including a bottom end for receiving the article there between and a top end), means formed exclusively of plastic for biasing the bottom ends together into an abutting, closed orientation while permitting separation of the bottom ends to a separated, open orientation, and spine means formed exclusively of plastic, separate from the biasing means, for pivotally securing together the components.

In a preferred embodiment, when the pinch-grip is in the closed orientation, the spine means defines a planar surface facing the bottom ends and biases the components toward the open orientation. Preferably one of the components defines a projection extending towards the other of the components, the other of the components defines an abutment surface extending towards the one component, and the projection and the abutment surfaces cooperatively engage one another side-by-side in the closed orientation to maintain both components aligned in a predetermined vertical relationship.

In another preferred embodiment, the biasing means has the configuration of an inverted U-shaped clip having an enlarged head at one end, and one of the components defines means for slidably securing the clip to the one component while resisting accidental separation of the enlarged head from the one component. The biasing means is in the configuration of an inverted U-shape having legs of unequal length, a shorter one of the legs being configured and dimensioned to bear on a movable one of the components, and a longer one of the legs being configured and dimensioned to bear on a stationary one of the components.

Preferably the biasing means has a pair of legs and is configured and dimensioned such that downward movement of the biasing means relative to the components causes automatic temporary separation of the pair of legs. One of the components may contain on an outer face of the top end thereof ridges of increasing height extending downwardly from adjacent the top end, the ridges acting as means for temporarily opening the biasing means. The bottom ends are moved from the closed orientation to the open orientation by manual movement of at least one of the top ends relative to the other of the top ends.

The present invention also a encompasses hinge for a pinch-grip formed exclusively of plastic, the hinge having a pair of vertically extending components and a spine means pivotally securing the components together, the spine means defining a planar surface facing bottom ends of the components and biasing bottom ends of the components apart.

BRIEF DESCRIPTION OF THE DRAWING

The above and related objects, features and advantages of the present invention will be more fully understood by reference to the following detailed description of the presently preferred, albeit illustrative, embodiments when taken in conjunction with the accompanying drawing wherein.

DETAILED DESCRIPTION OF THE PREFERRED EMBODIMENTS

Figure 1:
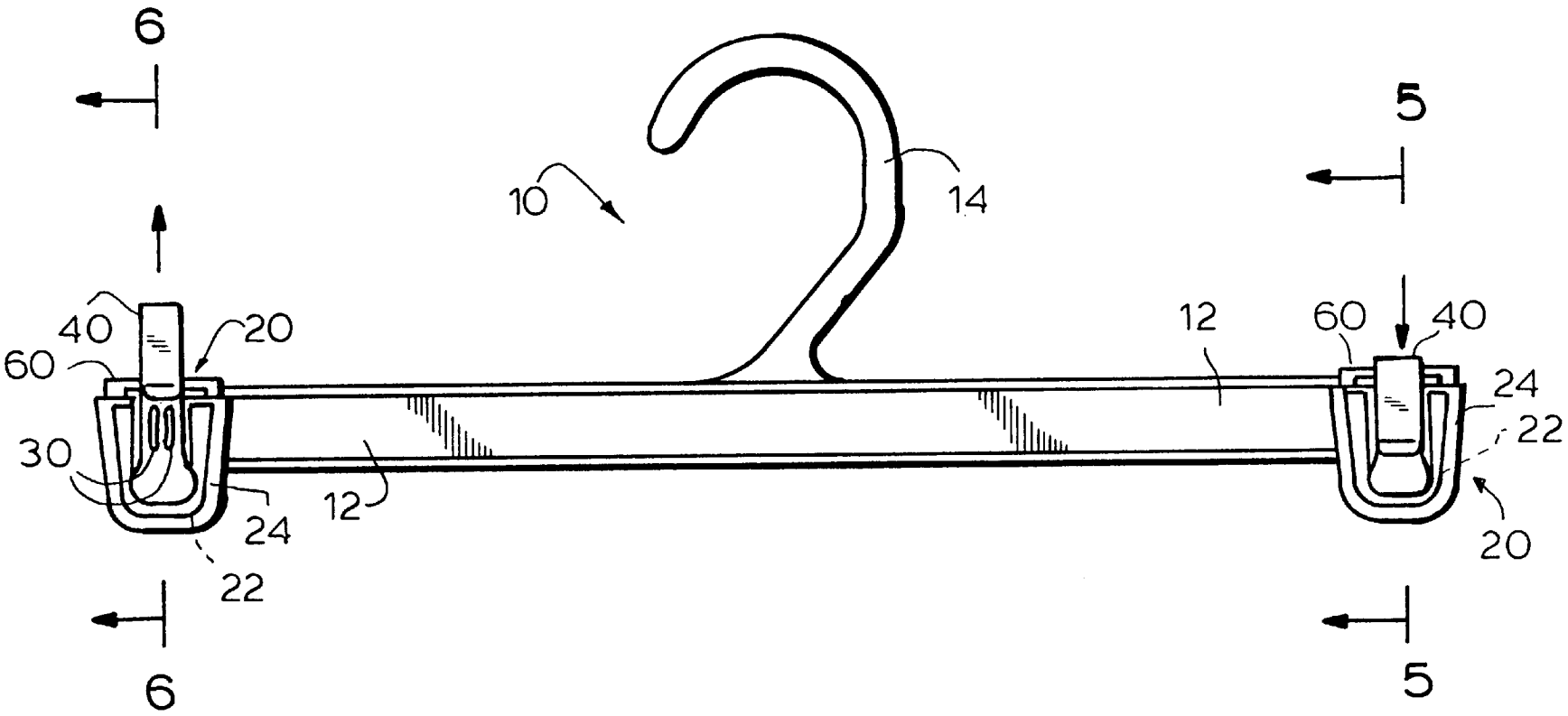
FIG. 1 is a front elevational view of a hanger according to the present invention, with the right pinch-grip in the abutting, closed orientation and the left pinch-grip in the separated, open orientation.

Referring now to the drawing, and in particular to FIG. 1 thereof, therein illustrated is a hanger according to the present invention, generally designated by the reference numeral 10. In its conventional aspects, the hanger comprises a hanger body 12 formed exclusively of plastic, an attachment portion 14 formed exclusively of plastic for securing the hanger body to a support (such as a support rod or closet rod extending horizontally), and at least one pinch-grip, generally designated 20.

The pinch grip 20 end is formed exclusively of plastic for receiving an article for hanging and depends from the hanger body 12. Depending upon the intended application of the hanger, there may be a single pinch-grip 20 centrally disposed beneath the hanger body 12, or, as shown, a pair of pinch-grips 20, one pinch-grip at each end of the hanger body 12.

Figure 3:
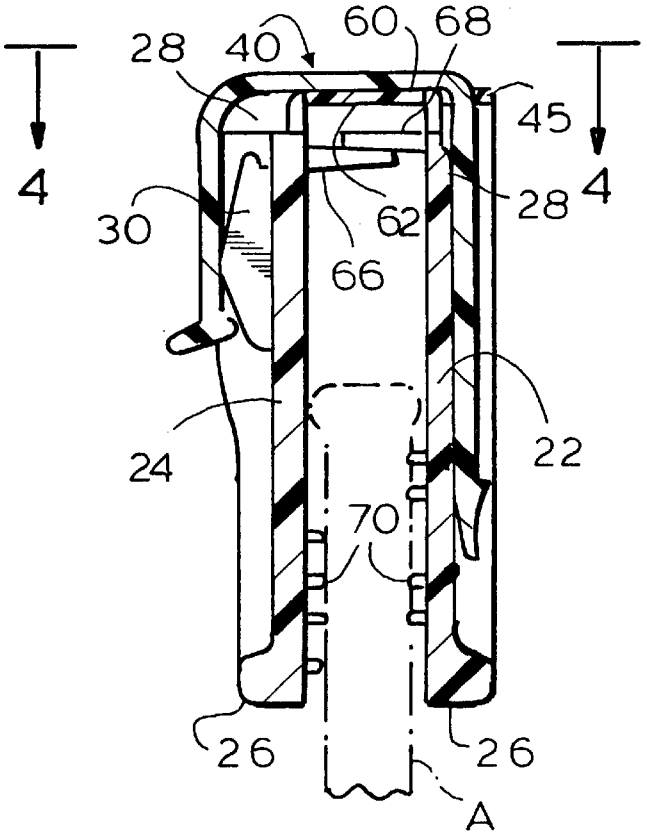
FIG. 3 is a sectional view taken along the line 3—3 of FIG. 2, with the pinch-grip illustrated in a semi-closed orientation and grasping an article illustrated in phantom line.
Figure 2:
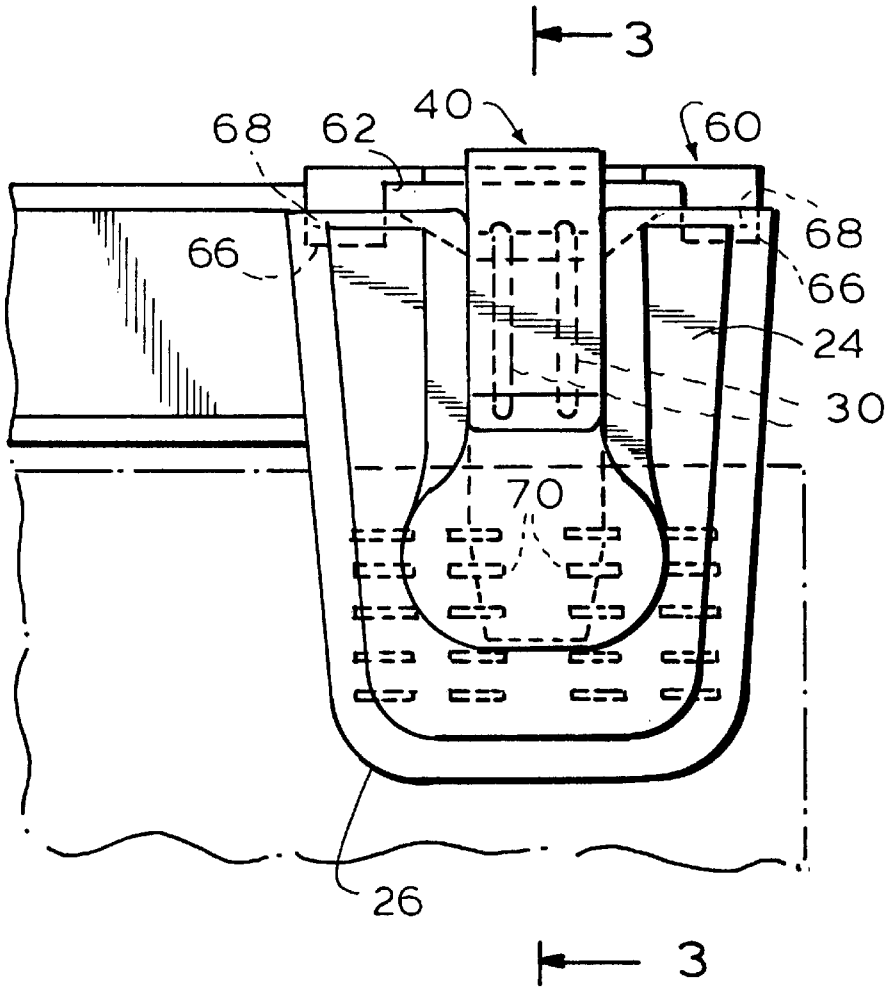
FIG. 2 is a fragmentary front elevational view of the right pinch-grip, to an enlarged scale.
Figures 4, 8:
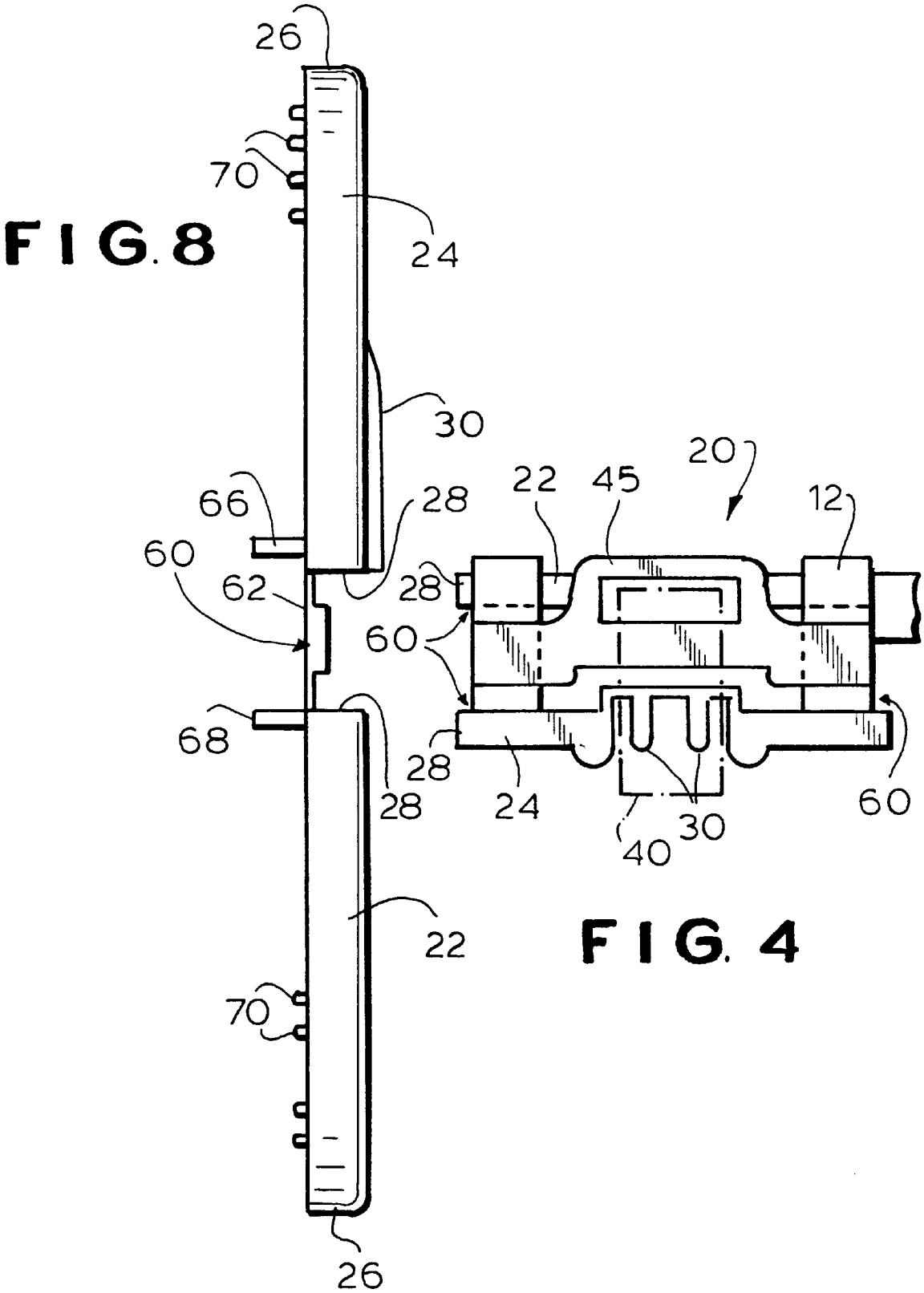
FIG. 4 is a top plan view taken along the line 4—4 of FIG. 3 showing the biasing means only in phantom line.
FIG. 8 is a sectional view thereof, taken along the line 8—8 of FIG. 7.

Referring now to FIGS. 2–4 in particular, each pinch-grip 20 includes a pair of component 22, 24 formed exclusively of plastic. Each component defines a bottom end 26 and a top end 28, the bottom ends 26 being configured and dimensioned to receive there between the article to be hung.

For reasons which will become apparent hereinafter, one of the components 22, 24 contains on an outer face of a top end 28 thereof short vertically extending ridges 30 of increasing height extending downwardly from adjacent the top end 28 such that the ridges 30 act as means for temporarily opening a biasing means.

In a preferred embodiment, one component 22, 24 is fixedly secured to the hanger body 12 and the other component 24 is movable relative to the stationary component 22 (and the hanger body 12). One of the components 22, 24 (preferably the movable component 24) defines at least one projection 66 extending towards the other of the components (preferably the stationary component 22), and the other of the components (preferably the stationary component 22) defines at least one abutment surface 68 extending towards the one component (preferably the movable component 24). Preferably the one component defines a horizontally spaced pair of the projections 66 and the other component defines a horizontally spaced pair of abutment surfaces 68.

Figure 6:
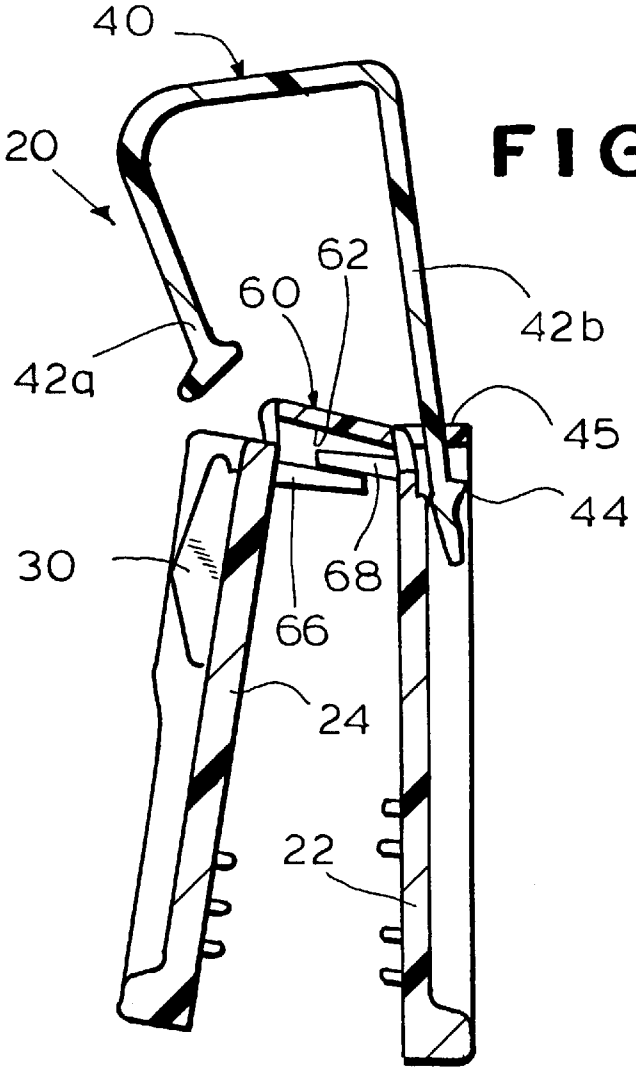
FIGS. 5 and 6 are sectional views taken along the lines 5—5 and 6—6, respectively.
Figure 5:
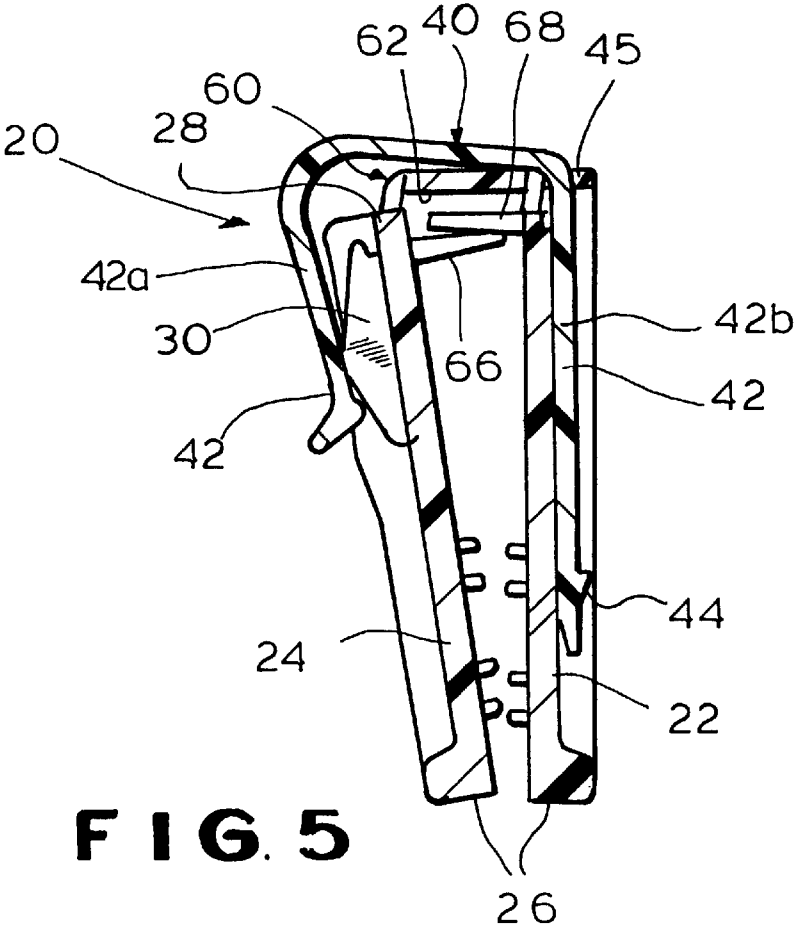

The pinch-grip 20 additionally includes means, generally designated 40, for biasing the bottom ends 26 of the components 22, 24 together into an abutting, closed orientation when there is no article there between, as illustrated in FIG. 5 (or into a non-abutting, semi-closed orientation when there is an article there between, as illustrated in FIG. 3), while permitting separation of the bottom ends 26 to a separated, open orientation, as illustrated in FIG. 6. In the closed orientation of FIG. 5 the bottom ends 26 abut without any article there between; in the semi-closed orientation of FIG. 3 each bottom end 26 abuts a respective opposed surface of the article A to suspend the article; and in the open orientation of FIG. 6 the bottom ends 26 are separated sufficiently to allow passage there between of the article A (that is, to allow insertion of an article there between or withdrawal of the article from its position there between).

The biasing means 40 is preferably configured and dimensioned as an inverted U-shaped clip having a pair of legs 42. Typically the legs 42 are of unequal length, a shorter one 42*a* of the legs 42 being configured and dimensioned to bear on a movable one 24 of the components and a longer one 42*b* of the legs 42 being configured and dimensioned to bear on a stationary one 22 of the components.

The legs 42 of the biasing means 40 preferably have an outer surface configured to facilitate grasping by a user's fingers in order to move the biasing means 40 between its elevated inoperative position and its lowered operative position.

In order to facilitate downward movement of the biasing means 40 relative to the components 22, 24 (from its elevated inoperative or non-biasing position to its lowered operative or biasing position) via an automatic separation of the legs 42 thereof, one of the components (preferably the movable 24 component) contains on an outer face of the top end 28 thereof at least one short vertically sloping projection or ridge 30. Initially the ridge 30 is of increasing height extending downwardly and outwardly from adjacent the top end 26; then it either terminates or extends downwardly and inwardly. The ridge 30 acts as means for temporarily opening the legs 42 of the biasing means 40 (preferably by movement of shorter leg 42*a*), as the biasing means 40, in response to downward manual pressure exerted by the user, moves from an elevated inoperative position (FIG. 6) into a lowered operative position (FIGS. 2, 3 and 5). After the leg passes the crest of the ridge 30, the moved leg moves or snaps back towards the other, into the operative orientation.

In the preferred embodiment of the present invention illustrated, the pinch-grip 20 additionally includes double-hinged spine means, generally designated 60, for pivotally securing together in horizontal alignment the components 22, 24. The spine means 60 has a pair of opposed long sides, each opposed long side being pivotally or hingedly secured to a different one of the components 22, 24 at the upper end 28 thereof. As illustrated, each opposed long side of the spine means 60 is preferably pivotally or hingedly secured at each end to a respective one of the component upper ends so that the connection between the spine means and each component upper end is formed by two hinges or pivots. The width of the spine means 60 between its opposed long sides is determined by the size of the article A intended to be suspended by the pinch-grip and may be relatively narrow to suspend a sheet, of normal width to suspend trousers, and relatively wider to suspend blankets, etc.

The spine means 60 is functionally and structurally separate and distinct from the biasing means 40, and, indeed, the spine means 60 secures together the components 22, 24, even when the biasing means 40 is removed from the pinch-grip 20. Preferably, as illustrated, the spine means 60 is of integral, unitary, one-piece construction with the components 22, 24, and is formed therewith in a single molding operation. When the pinch-grip 20 is in the closed orientation, the spine means 60 defines a planar surface 62 which faces the bottom ends 26 of the components 22, 24. The planar surface 62 is preferably connected to the components 22, 24 only at the lateral sides thereof, with a substantial central length of the planar surface being spaced from the adjacent components to facilitate the hinge action of the planar surface 62 with each component.

As illustrated, projections 66 are disposed adjacent the lateral sides of the top end 28 of the movable component 24 and extend towards the top end 28 of the other component 22, and abutment surfaces 68 are disposed adjacent the lateral sides of the top end 26 the stationary component 22 and extend towards the top end 28 of the other component 24. The projections 66 are immediately in front of the abutment surfaces 68 (in side-by-side relationship) when the pinch-grip 10 is properly in the closed or semi-closed orientation. The abutment of projections 66 and abutment surfaces 68 ensures appropriate horizontal alignment between the bottom ends 26 of the two components 22, 24. Further, the projection 66 and abutment surfaces 68 limit the closing action exerted by the bias means 40 on the article A being suspended by the components by insuring a minimum separation of the components top ends 28. To this end, the spine means is of more than usual thickness to insure the proper resiliency for biasing the components 22, 24—for example, 0.030 inch thickness.

The spine means 60 preferably biases the components 22, 24 towards the open orientation. The biasing pressure exerted by the spine means 60 is substantially less than the biasing pressure exerted by the biasing means 40 such that, when the biasing means 40 is in the lowered operative position, it easily overcomes the biasing of the spine means 60. On the other hand, when the biasing means 40 is in the elevated inoperative position, the relatively minor biasing force of the spine means 60 bias is sufficient to force the top ends 28 of the components 22, 24 into the separated, open orientation. Accordingly, when the biasing means 40 is in the inoperative position, the bottom ends 26 of the components 22, 24 automatically assume a separated, open orientation enabling the article to be passed there between. In this manner, the hanger user does not have to fumble with the components 22, 24 in order to manually place them in the separated, open orientation.

In order to prevent accidental separation of the biasing means 40 from the remainder of the pinch-grip 20 (and the hanger 10), one of the legs 42 (preferably the longer leg 42*a*) has an adjacent a free end thereof an enlarged head 44, and the spine 60 (as illustrated, at the back of the pinch-grip) or one of the components 22, 24 (preferably the stationary component 22) defines means 45 for slidably securing the biasing means back leg 42 with the enlarged head 44 to the spine 60 (or the component) in such a way as to resist accidental separation of the enlarged head 44 from the spine (or component). The enlarged head 44 need only slightly exceed in one dimension the available opening formed by the securing means 45 such that the enlarged head 44 can be forcibly inserted onto the pinch-grip 20 through the securing means 45, but precludes accidental non-forcible passage of the enlarged head 44 through the securing means 45. To this end, one or both of the securing means 45 and the enlarged head 44 is preferably slightly flexible or compressible.

Figure 7:
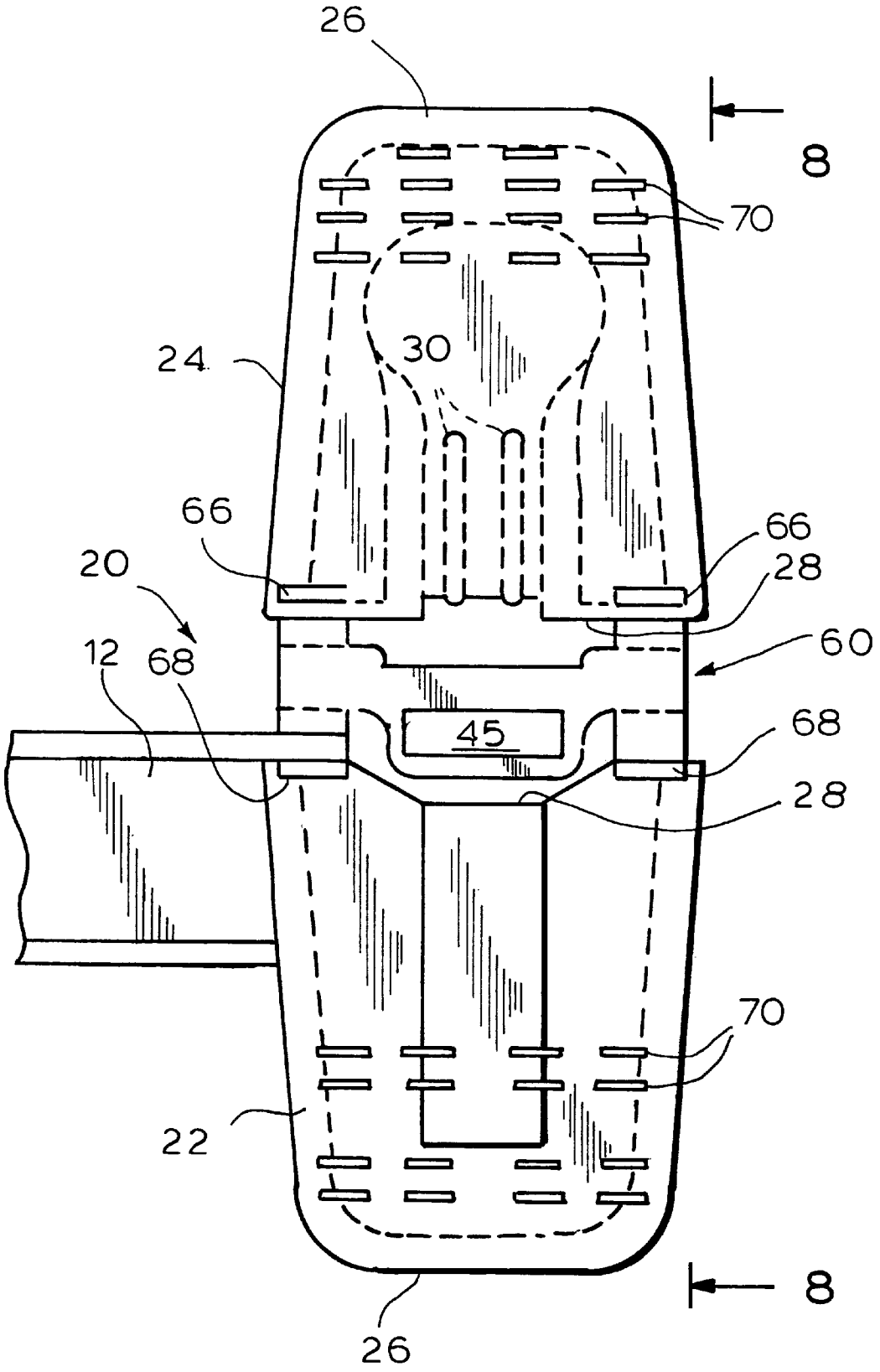
FIG. 7 is a front elevational view of a pinch-grip with the components in a common plane, as might be found during a stage of manufacture.

Unlike the spine means 60, the biasing means 40 is molded separately from the remainder of the pinch-grip 20, although it may be formed of like or different materials during the same molding operation. Referring now to FIGS. 7 and 8 in particular, therein illustrated is the remainder of the pinch-grip—that is, the pinch-grip without the biasing means 40. The pinch-grip is illustrated with the components 22, 24 thereof in a completely open position such that the components 22, 24 extend substantially in a single vertical plane. This completely open orientation is typical during the manufacturing process, but it is not a standard orientation of a pinch-grip once the biasing means 40 has been applied thereto. The facing lower ends 26 of the components 22, 24 (when in the closed or semi-closed orientation) may contain mini-projections 70 or like means for enhancing frictional retention of an article A between the facing component lower ends.

Precisely because the pinch-grip 20 is molded in a completely open position with the components 22, 24 (and the spine means 60) extending substantially in a single plane, the pinch-grip 20 may be mass manufactured more economically and more easily. Whereas a conventional molding process requires the use of "inserts" to provide the particularly complex surfaces and shapes required (so that the inserts may be created separate from the mold), the pinch grip of the present invention eschews such intricate designs and can be made in a mold without inserts. As a result, the molding operation is faster and cheaper (because the inserts are typically expensive to manufacture and must then be inserted into the mold) and the longevity of the mold is greater (because the inserts wear out rapidly under typical molding operation conditions). Accordingly, the present invention is made in a mold which is easy and economical to use and maintain.

A critical feature of the present invention is that the entire pinch-grip hanger—that is, the hanger body 12, the attachment portion 14, and the pinch-grips 20 (including the components 22, 24, the biasing means 40, and the spine means 60)—are formed exclusively of plastic, thereby to reduce material and manufacturing costs. The biasing means 40 is preferably formed of a clear polycarbonate or an acetyl plastic applying high strength even at below thickness. Thus polycarbonate affords 20 to 30 times the strength of metal of equivalent weight, while still being manually deformable. Additionally, the present invention features a double-hinged spine means 60 which is pivotally connected to each of the components 22, 24 of the pinch-grip 20, biases them to the open orientation, assists in maintaining them in proper horizontal alignment in the closed orientation, and generally facilitates use of the hanger by the user.

To summarize, the present invention provides a pinch-grip hanger formed exclusively of plastic, each pinch grip including spine means separate from the biasing means for pivotally securing together the components and insuring appropriate alignment to the bottom ends. Further, the bottom ends of the components are biased towards a separated open orientation to facilitate passage of articles there between when the primary biasing means is in an inoperative position. The hanger is inexpensively and easily manufactured, used an maintained.

Now that the preferred embodiments of the present invention have been shown and described in detail, various modifications and improvements thereon will become readily apparent to those skilled in the art. Accordingly, the spirit and scope of the present invention is to be construed broadly and limited only by the claims, not by the foregoing specification.

I claim:

1. A pinch-grip hanger comprising:

(A) an attachment portion formed exclusively of plastic for securing said hanger to a support; and (B) at least one pinch-grip formed exclusively of plastic for receiving an article for hanging, said pinch-grip including:

(i) a pair of components formed exclusively of plastic, each of said components including a bottom end for receiving the article therebetween and a top end; and (ii) means formed exclusively of plastic for biasing said bottom ends together into an abutting closed orientation enabling retention of a garment portion therebetween, while permitting separation of said bottom ends to a separated open orientation enabling passage of a garment portion therebetween;

(iii) spine means formed exclusively of plastic, separate from said biasing means, for pivotally securing together said components and biasing said bottom ends of said components toward said open orientation, said spine means defining a planar surface of substantial width securing together said components.

2. The hanger of claim 1 wherein said spine means has a pair of opposed sides, each opposed side being pivotally secured to a different one of said components, and, when said pinch-grip is in said closed orientation, said spine means defines a planar surface facing said bottom ends.

3. The hanger of claim 1 wherein one of said components defines above said bottom end a projection extending towards the other of said components, the other of said components defines above said bottom end an abutment surface extending towards aid one component, and said projection and said abutment surface cooperatively engage one another side-by-side above said bottom ends in the closed orientation to maintain both components aligned in a predetermined relationship.

4. The hanger of claim 1 wherein said biasing means has the configuration of an inverted U-shaped clip having an enlarged head at one end, and one of said components defines means for slidably securing said clip to said one component while resisting accidental separation of said enlarged head from said one component.

5. The hanger of claim 1 wherein said biasing means is in the configuration of an inverted U-shape having legs of unequal length, a shorter one of said legs being configured and dimensioned to bear on a movable one of said components and a longer one of said legs being configured and dimensioned to bear on a stationary one of said components.

6. The hanger of claim 1 wherein said biasing means has a pair of legs and is configured and dimensioned such that upward movement of said biasing means relative to said components causes automatic separation of said pair of legs.

7. A pinch-grip hanger comprising:

(A) an attachment portion formed exclusively of plastic for securing said hanger to a support; and (B) at least one pinch-grip formed exclusively of plastic for receiving an article for hanging, said pinch-grip including:

(i) a pair of components formed exclusively of plastic, each of said components including a bottom end for receiving the article therebetween and a top end; and (ii) means formed exclusively of plastic for biasing said bottom ends together into an abutting closed orientation enabling retention of a garment portion therebetween, while permitting separation of said bottom ends to a separated open orientation enabling passage of a garment portion therethrough;

(iii) spine means formed elusively of plastic, separate from said biasing means, for pivotally securing together said components and biasing said bottom ends of said components toward said open orientation, said spine means defining a planar surface of substantial width securing together said components;

said biasing means having a pair of legs and being configured and dimensioned such that downward movement of said biasing means relative to said components causes automatic separation of said pair of legs;

one of said components containing on an outer face of said top end thereof ridges of increasing height extending downwardly from adjacent said top end, said ridges acting as means for temporarily opening said biasing means.

8. The hanger of claim 1 wherein said bottom ends are moved from said closed orientation to said open orientation by manual movement of at least one of said top ends relative to the other of said top ends.

9. A pinch-grip hanger comprising:

(A) a hanger body formed exclusively of plastic and an attachment portion formed exclusively of plastic for securing said hanger body to a support; and (B) at least one pinch-grip formed exclusively of plastic for receiving an article for hanging, said pinch-grip depending from said hanger body and including:

(i) a pair of components formed exclusively of plastic, each of said components including a bottom end for receiving the article therebetween and a top end;

(ii) means formed exclusively of plastic for biasing said bottom ends together into an abutting, closed orientation while permitting separation of said bottom ends to a separated, open orientation; and (iii) spine means formed exclusively of plastic, separate from said biasing means, for pivotally securing together said components, said spine means defining a planar surface of substantial width securing together said components, facing said bottom ends when said pinch-grip is in said closed orientation and biasing said components toward said open orientation;

one of said components defining a projection above said bottom end extending towards the other of said components, the other of said components defining an abutment surface above said bottom end extending towards said one component, and said projection and said abutment surface cooperatively engaging one another side-by-side above said bottom ends in a predetermined relationship;

one of said components containing on an outer face of said top end thereof ridges of increasing height extending downwardly from adjacent said top end, said ridges acting as means for temporarily opening said biasing means, said biasing means being configured and dimensioned such that downward movement of said biasing means relative to said components and along said ridges causes automatic separation of said pair of legs.

10. The hanger of claim 9 wherein said biasing means has the configuration of an inverted U-shaped clip having an enlarged head at one end, and one of said component defines means for slidably securing said clip to said one component while resisting accidental separation of said enlarged head from said one component, said clip having legs of unequal length, a shorter one of said legs being configured and dimensioned to bear on a movable one of said components and a longer one of said legs being configured and dimensioned to bear on a stationary one of said components, said biasing means being configured and dimensioned such that downward movement of said biasing means relative to said components and along said ridges causes automatic separation of said pair of legs.

11. A pinch-grip hanger formed exclusively of plastic, comprising:

(A) a hanger body formed exclusively of plastic and an attachment portion formed exclusively of plastic for securing said hanger body to a support; and (B) at least one pinch-grip formed exclusively of plastic for receiving an article for hanging, said pinch-grip depending from said hanger body and including:

(i) a pair of components formed exclusively of plastic, each of said components including a bottom end for receiving the article therebetween and a top end;

(ii) means formed exclusively of plastic for biasing said bottom ends together into an abutting, closed orientation while permitting separation of said bottom ends to a separated, open orientation; and (iii) spine means formed exclusively of plastic, separate from said biasing means, for pivotally securing together said components, said spine means defining a planar surface of substantial width securing together said components.

* * * * *